United States Patent [19]

Bourrie et al.

[11] 3,942,828

[45] Mar. 9, 1976

[54] ELECTROMECHANICAL DEVICE CUM MANUAL CONTROL OF SAFETY OUTFIT BOXES ON AIRCRAFTS

[75] Inventors: Georges E. Bourrie, Neuilly-sur-Seine; Robert M. Lensel, Bourg-la-Reine, both of France

[73] Assignee: R. Alkan & Cie, Valenton, France

[22] Filed: Apr. 10, 1975

[21] Appl. No.: 566,710

[30] Foreign Application Priority Data

Apr. 18, 1974 France ..... 74.13508

[52] U.S. Cl. ..... 292/201

[51] Int. Cl.[2] ..... E05C 3/06

[58] Field of Search ..... 292/201, 144, 216, 229

[56] References Cited

UNITED STATES PATENTS

| | | | |
|---|---|---|---|
| 1,199,199 | 9/1916 | Mason | 292/201 |
| 1,429,389 | 9/1922 | Weintz | 292/216 |
| 1,456,114 | 5/1923 | Beacham | 292/216 |
| 2,647,789 | 8/1953 | Chayne | 292/144 X |
| 2,676,047 | 4/1954 | Gould | 292/229 |
| 2,752,189 | 6/1956 | Bachi et al. | 292/201 X |
| 3,504,511 | 4/1970 | Allen | 292/201 X |
| 3,635,511 | 1/1972 | Waller | 292/201 X |
| 3,658,370 | 4/1922 | Wang | 292/201 |
| 3,753,316 | 8/1973 | Savarieau et al. | 49/31 |

FOREIGN PATENTS OR APPLICATIONS

| | | | |
|---|---|---|---|
| 150,662 | 7/1955 | Sweden | 292/201 |
| 1,562,878 | 3/1969 | France | 292/144 |

*Primary Examiner*—Roy D. Frazier
*Assistant Examiner*—Thomas J. Holko
*Attorney, Agent, or Firm*—Ulle C. Linton

[57] ABSTRACT

This electromechanical device with a manual emergency control for opening the door of a safety outfit box on board an aircraft comprises in said box a spring-loaded piston responsive to an electromagnet and having a head shaped to control the movements of registering locking members into or out from their locking position in which they engage a retaining hook engageable in turn with a cross member of a strap carried by the door. Said locking members may consist of balls or small ball-bearings engageable in corresponding holes formed in a sleeve concentric to said piston. Manual control means are provided for actuating said piston from the outside and thus opening the door in case of emergency.

5 Claims, 6 Drawing Figures

ELECTROMECHANICAL DEVICE CUM MANUAL CONTROL OF SAFETY OUTFIT BOXES ON AIRCRAFTS

BACKGROUND OF THE INVENTION

1. Field of the invention

The present invention relates to electromechanical devices comprising an emergency manual control system for opening the doors of containers or boxes enclosing safety outfits, such as masks and possibly oxygen generators on board aircrafts.

2. Description of the Prior Art

Devices intended for the same purpose have already been disclosed in the U.S. Pat. No. 3753316 of the same applicants.

In this prior patent a box or case comprising a pivoting door incorporated in the box structure is disclosed, in contrast to the present invention directed primarily to means for locking a door adapted and pivoted to a separate box or chamber, wherein the degree of precision of the fitting of said door to the box is not so important as in the preceding structures, whereby the device allows a wider range of tolerances in the relative positions of the fixed components rigid with said box and the movable components rigid with the door.

In the above-mentioned patent the locking device interposed between the two portions, namely the fixed portion and the movable portion, comprises a movable spring-loaded piston carried by one of said two portions and co-acting with locking means engaging directly the other portion, so that the relative positions of said two portions must be determined with a high degree of precision.

SUMMARY OF THE INVENTION

According to this invention, a spring-loaded piston is also carried by one of the two portions and controls likewise locking members, but these, instead of engaging directly the other portion, hold against motion an intermediate pivoting retaining hook co-acting with a strap carried by the other portion.

With this arrangement, the retaining hook may be designed to allow a greater tolerance in the relative positions of the two portions and also to constitute a power or step-up lever, the opening effort exerted on the door transmitting to the locking system only a scaled-down force more propitious to the safety of operation of the assembly.

DESCRIPTION OF THE PREFERRED EMBODIMENTS

Figure 1:
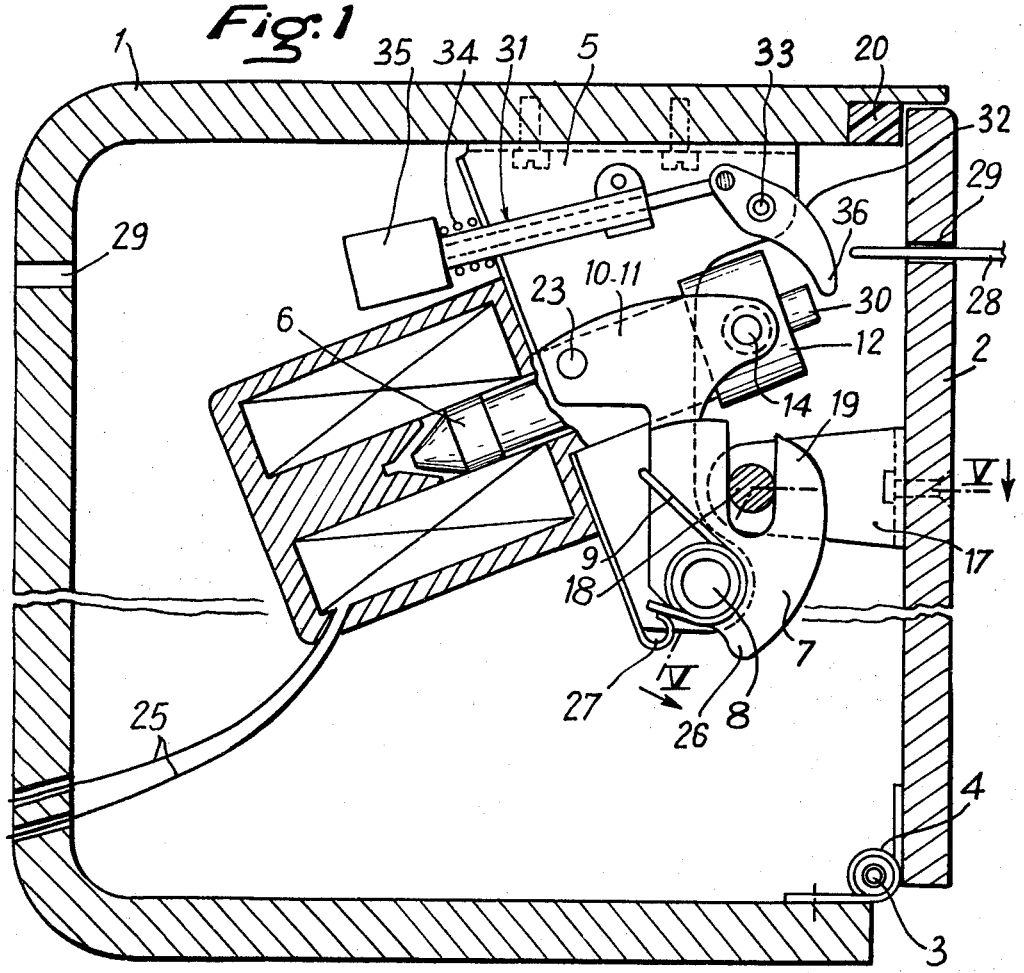
FIG. 1 shows in longitudinal section the door opening device in its door locking position.

Referring first to FIG. 1, there is shown diagrammatically the box or chamber 1 containing the safety outfits (not shown) and the door 2 of said box which is pivoted about hinge means 3 provided with spring means 4 constantly urging said door 2 to its open position. Secured to one wall of box 1 is the support 5 carrying on the one hand the locking device comprising a plunger 6 responsive to an electromagnet coil, and on the other hand the hook 7 pivoted about a pin 8 rigid with said support. This hook 7 is also urged to its door opening position by a spring 9 and comprises two parallel symmetric wings 10, 11 adapted, during the pivoting movement of said hook 7, to slide with the minimum clearance on one and the other side of a ball locking device 12 comprising for example a sleeve in which the piston head 13 rigid with said plunger 6 is movable, the balls 15, 16 are retained in holes formed through the wall of said sleeve so as to be engageable by said piston head 13. Said parallel symmetric wings 10, 11 comprise gaged holes 14 adapted, in the closed position of said hook 7, to register with the balls 15, 16 held in their outward position by the piston head 13 in order to hold the hook 7 in this position.

Secured to the door 2 is a strap 17 of which the cross member 18 is engaged into the notch 19 of hook 7 in the closed position thereof. In FIG. 1 it will be seen that in this position the door 2 is kept closed against a resilient gasket 20 lining the registering edge of box 1.

Figure 2:
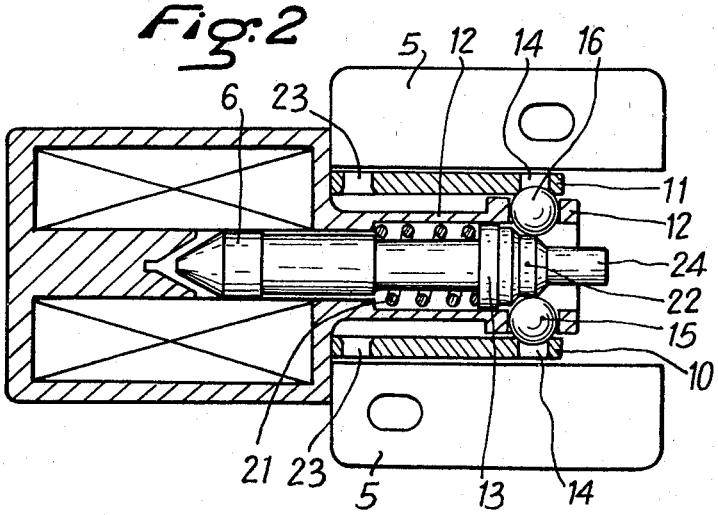
FIG. 2 is a corresponding axial section of the ball locking device.

FIG. 2 is an axial section showing the ball locking device, the piston head 13 being shown in its outer or locking position by a spring 21. The diameter of the cylindrical wide portion 22 of this piston causes the balls 15 and 16 to partially penetrate into the holes 14 formed in the wings 10 and 11 of hook 7. Other holes 23 may be formed in said wings 10 and 11 for locking or positioning the hook in its opening position.

Figure 3:
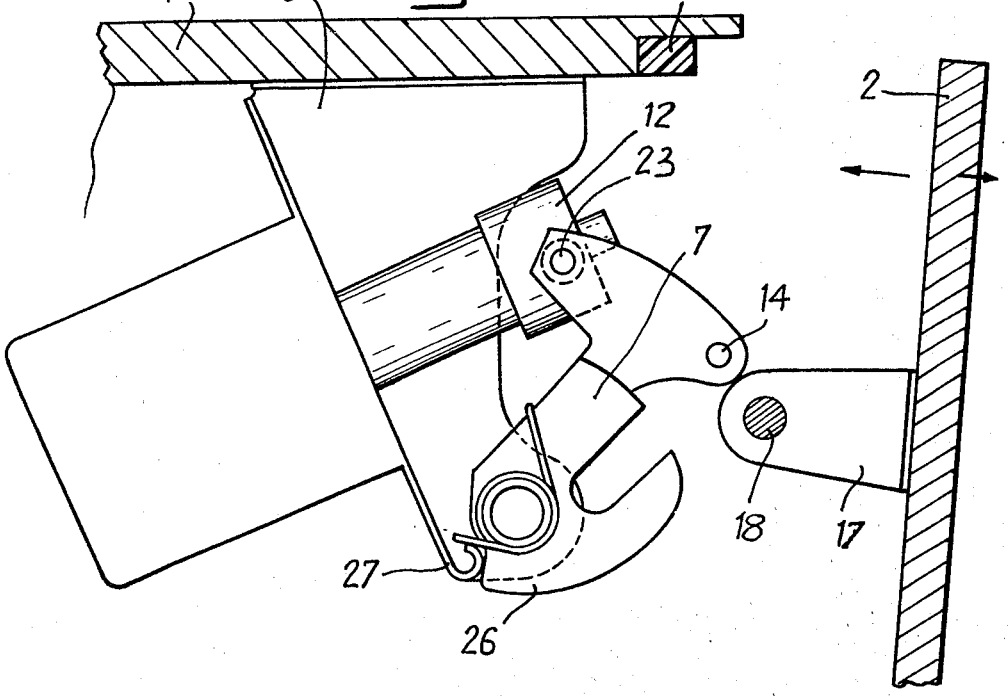
FIG. 3 is a view similar to one portion of FIG. 1 but showing the device in the door opening position.

FIG. 3 shows the hook 7 in its open position, i.e. to open the door 2. This release position is also a waiting position so that the hook 7 can receive the cross member 18 of strap 17 and lock same during the closing movement of door 2.

Figure 4:
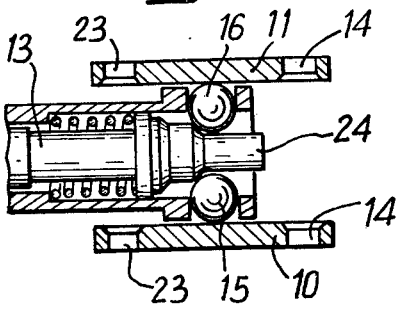
FIG. 4 is a view similar to one portion of FIG. 2 but showing the retaining hook in its released position.
Figure 5:
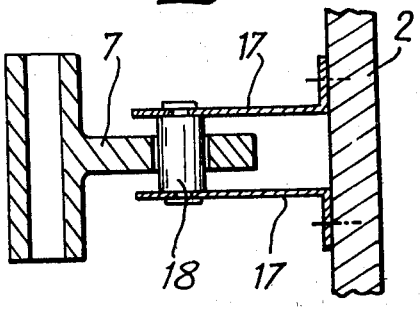
FIG. 5 is a detail section showing the retaining hook in the door closing position, the section being taken along the line V—V of FIG. 1

FIG. 4 illustrates the piston head 13 in its retracted position in which a cylindrical portion 24 of reduced diameter registers with balls 15 and 16. In this Figure, the wings 10 and 11 of hook 7, are shown intermediate the opening and closing positions of said hook 7.

Now the mode of operation of the device of this invention, as illustrated in FIGS. 1 to 5 of the drawings, will be described. The door 2, when closed as illustrated in FIG. 1, cannot be opened since it is retained by hook 7, the latter being locked in turn in this position by the balls 15 and 16 engaging the holes 14 of wings 10 and 11.

If the electromagnet controlling the plunger core 6 is energized through the supply wires 25, said plunger core 6 will be attracted and the portion 24 of reduced diameter of piston head 13 will register with said balls 15 and 16, thus enabling these balls to be retracted within the sleeve 12 and releasing the wings 10 and 11 of hook 7, as shown in FIG. 4. Due to the force exerted by its spring 9, the hook 7 is rotated in the clockwise direction, as seen in FIGS. 1 and 3, thus releasing the cross member 18 of strap 17 and permitting the opening of door 2 as a consequence of the permanent force of its spring 4.

The opening or release movement of hook 7 is limited by the engagement produced between its heel 26 and the portion 27 of support 5, so that the holes 23 in wings 10 and 11 eventually register with balls 15 and 16. When the energizing current is cut out, the spring 21 restores the piston head 13 to its position corresponding to the outer position of said balls 15 and 16. Thus, hook 7 is positively retained in its opening position and the door 2 cannot be re-closed by a person unaware of this fact, since a discrete action must be exerted on the piston beforehand. It is therefore clear that if the holes 23 were dispensed with it would only be sufficient to move the door towards its closed position for causing the cross member 18 of strap 17 to engage the notch of hook 7 and pivot same automatically to its closed and locking position.

The above-mentioned discrete action may be exerted for instance by means of a thin rod 28 inserted through one of the two through holes 29 formed the one in the bottom of box 1 and the other in the door 2, so as to push the end 30 of piston head 13. If the reset action is to take place through the box or chamber 1, a control device 31 connected to a reversing lever 32 fulcrumed to a pivot pin 33 rigid with support 5 and normally held in a neutral position by said control device 31 responsive to a coil spring 34 is provided. Thus, when the head 35 of this control device 31 is pushed by means of a thin rod 28 inserted through the hole 29 formed in the wall of box 1, the spring 34 is compressed and the reversing lever 32 is caused to engage with its driving end 36 the outer end 30 of the piston so that the latter is moved backwards and the balls 15 and 16 can resume their retracted position illustrated in FIG. 4. On the other hand, when this control action is exerted by means of a similar or same thin rod 28 inserted through the hole 29 formed in said door 2, as illustrated in FIG. 1, the operative end 36 of lever 32 is engaged and pushes the piston head 13 in order to retract likewise the balls 15 and 16. This action exerted through the door or through the box wall is also useful for opening the door manually in case of emergency.

It will be noted that the strap 17 is considerably wider than the thickness of hook 7 in the direction of its pivot axis, so that a substantial tolerance is afforded in the lateral alignment of these parts. On the other hand, the position of cross member 18 in the notch 19 of hook 7 does not require either a great precision in the longitudinal alignment thereof. The resiliency of gasket 20 is also useful in that the door can be depressed more or less for closing the hook 7 and locking the assembly.

Figure 6:
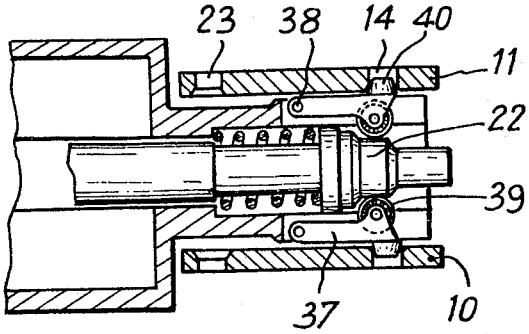
FIG. 6 shows a modified construction of the piston-type locking means, operated by means of an electromagnet, in which the piston, instead of engaging lock balls, engages different elements having a similar function.

If desired, other members may be substituted for the balls 15 and 16, for instance members of which the protrusion or retraction are caused by the piston head 13, a typical example of a modified device of this character being shown in FIG. 6. In this example, the portion 22 of the piston head 13 is adapted to actuate levers 37 fulcrumed on pivot pins 38 and comprising small ball-bearings 39. These levers 37 are each provided with a small frustoconical head 40 adapted, in the locking position of piston head 13 as illustrated in FIG. 6, to engage one of the holes 14 formed in wings 10 and 11 of hook 7. The use of ball-bearings is advantageous in that it reduces frictional contacts, the force necessary for withdrawings the piston head 23 and therefore the power necessary for releasing the device.

It is clear for those conversant with the art that the specific forms of embodiment described hereinabove with reference to the accompanying drawings should not be construed as limiting the present invention since many modifications and changes may be brought thereto without departing from the basic principles of the invention as set forth in the appended claims.

What we claim is:

1. Electromechanical device with manual emergency control for opening the door of a safety outfit box on board an aircraft, comprising a box having two portions to be interlocked, an electromagnet being mounted in said box, a spring loaded piston responsive to and slideably mounted on said electromagnet and having a head formed with successive axial portions having different diameters, locking members being associated with said piston head and adapted to take either an outward projecting locking position or a retracted release position, a retaining hook pivotally mounted on one of the two portions of said box to be interlocked, a strap carried by the other of said box portions and positioned for being engaged and retained by said hook, said retaining hook comprising in planes perpendicular to its axis of pivotal movement a pair of parallel symmetrical wings each provided with a hole for receiving said locking members in the locking position.

2. Device as claimed in claim 1, wherein said box presents at least one opening, a rod insertable through said opening for engaging said piston head for pushing back said spring-loaded piston and consequently moving said locking members to their retracted release position.

3. Device as claimed in claim 1, wherein each of said symmetrical wings of said retaining hook has a pair of holes with said holes being positioned for being engaged by said locking members in the locking position and the release position of said box door respectively.

4. Device as claimed in claim 1, wherein said locking members comprise balls positioned for being pushed by said piston, a cylindrical sleeve surrounding said piston and having holes in the wall of said sleeve with said balls in said holes and moveable therein as a function of the diameter of the portion of said piston head registering with said balls.

5. Device as claimed in claim 1, including a sleeve surrounding said piston and wherein said locking member comprise elements pivoted to said sleeve surrounding said piston, a small ball-bearing is carried at the free end of each of said element and is responsive to said piston and a locking head formed on each of said elements and said retaining hook has holes positioned for receiving said locking heads.

* * * * *